US011540597B1

(12) United States Patent
Rowland et al.

(10) Patent No.: US 11,540,597 B1
(45) Date of Patent: Jan. 3, 2023

(54) BELT BUCKLE SYSTEM

(71) Applicant: TEAM NexBelt Operating, Inc., Rancho Cucamonga, CA (US)

(72) Inventors: Edward Rowland, Rancho Cucamonga, CA (US); Tom Hunsucker, Rancho Cucamonga, CA (US)

(73) Assignee: TEAM NexBelt Operating, Inc., Rancho Cucamonga, CA (US)

( * ) Notice: Subject to any disclaimer, the term of this patent is extended or adjusted under 35 U.S.C. 154(b) by 0 days.

(21) Appl. No.: 17/151,360

(22) Filed: Jan. 18, 2021

Related U.S. Application Data

(60) Provisional application No. 62/963,083, filed on Jan. 19, 2020.

(51) Int. Cl.
*A44B 11/12* (2006.01)
*A41F 9/00* (2006.01)

(52) U.S. Cl.
CPC ..... *A44B 11/12* (2013.01); *A41F 9/002* (2013.01)

(58) Field of Classification Search
CPC ..... A44B 11/12; A44B 11/24; A44B 11/006; A44B 11/065; A41F 9/002
See application file for complete search history.

(56) References Cited

U.S. PATENT DOCUMENTS

| | | | | |
|---|---|---|---|---|
| 9,155,359 | B1 * | 10/2015 | Bailey | A44B 11/065 |
| 10,070,701 | B1 * | 9/2018 | Liu | A44B 11/125 |
| 10,357,082 | B2 * | 7/2019 | Liu | A44B 11/24 |
| 2007/0130735 | A1 * | 6/2007 | Diamond | A44B 11/24 24/636 |
| 2014/0215766 | A1 * | 8/2014 | Liu | A44B 11/006 24/188 |
| 2017/0314590 | A1 * | 11/2017 | Hunsucker | A41F 9/002 |
| 2020/0121032 | A1 * | 4/2020 | Vaccari | A44B 11/2592 |

* cited by examiner

*Primary Examiner* — David M Upchurch
(74) *Attorney, Agent, or Firm* — Foley & Lardner LLP

(57) ABSTRACT

A belt buckle system includes a belt buckle frame member having an internal shaft, a first elongated actuator member slidingly positioned within the internal shaft, and a first latch member positioned within the buckle frame. The latch member rotates between an extended position and a retracted position and has a latch portion that extends outward from the belt buckle frame when the first latch member is in the member extended position and wherein the latch portion of the first latch member is positioned within the frame when the latch member is in the retracted position. The first elongated actuator actuates to transition the first latch member between the extended position and the retracted position.

16 Claims, 26 Drawing Sheets

BELT BUCKLE SYSTEM

This application claims the benefit of priority to U.S. Patent Application Ser. No. 62/693,083 entitled "Belt Buckle System" and filed on Jan. 19, 2020. The application is incorporated by reference in its entirety.

BACKGROUND

Conventional belt buckles or belt adjustment systems are limited in their ability to conform to a particular user's waist size. Belt adjustment systems conventionally secure a belt about a user's waist by relying on a series of spaced holes punched through an end of a belt. A hook of a belt buckle can be inserted through a hole to capture the end of the belt to secure the belt in a loop of a particular size. The spacing between each of the holes as well as the overall number of holes can vary for adjustment of belt size but is generally limited by the minimal material that must remain between the holes.

Conventional belt adjustment systems are limited to setting the size of the belt loop to discrete sizes based upon the spacing of the holes in the belt. If a user desires to set the belt to a loop size that is positioned between the holes in the belt, the user has to manually create an additional hole in the belt, which can be difficult and unattractive if not performed well. Alternately, the user must use the next smaller or next larger belt loop size relative to the desired size, which can be uncomfortable for the user.

To deal with these drawbacks, there are pinless belt buckle systems that use a ratcheting belt buckle that is removably attached to a belt. The buckle includes a clamp that clamps onto one end of the belt. There is a need for improved pinless buckle systems.

SUMMARY

Disclosed is an improved belt buckle system that removably clamps onto a belt with a secure clamping mechanism.

Other features and advantages should be apparent from the following description of various embodiments, which illustrate, by way of example, the principles of the claimed subject matter.

BRIEF DESCRIPTION OF THE DRAWINGS

These and other aspects will now be described in detail with reference to the following drawings.

DETAILED DESCRIPTION

Before the present subject matter is further described, it is to be understood that this subject matter described herein is not limited to particular embodiments described, as such may of course vary. It is also to be understood that the terminology used herein is for the purpose of describing particular embodiments only and is not intended to be limiting. Unless defined otherwise, all technical terms used herein have the same meaning as commonly understood by one skilled in the art to which this subject matter belongs.

Figure 1:
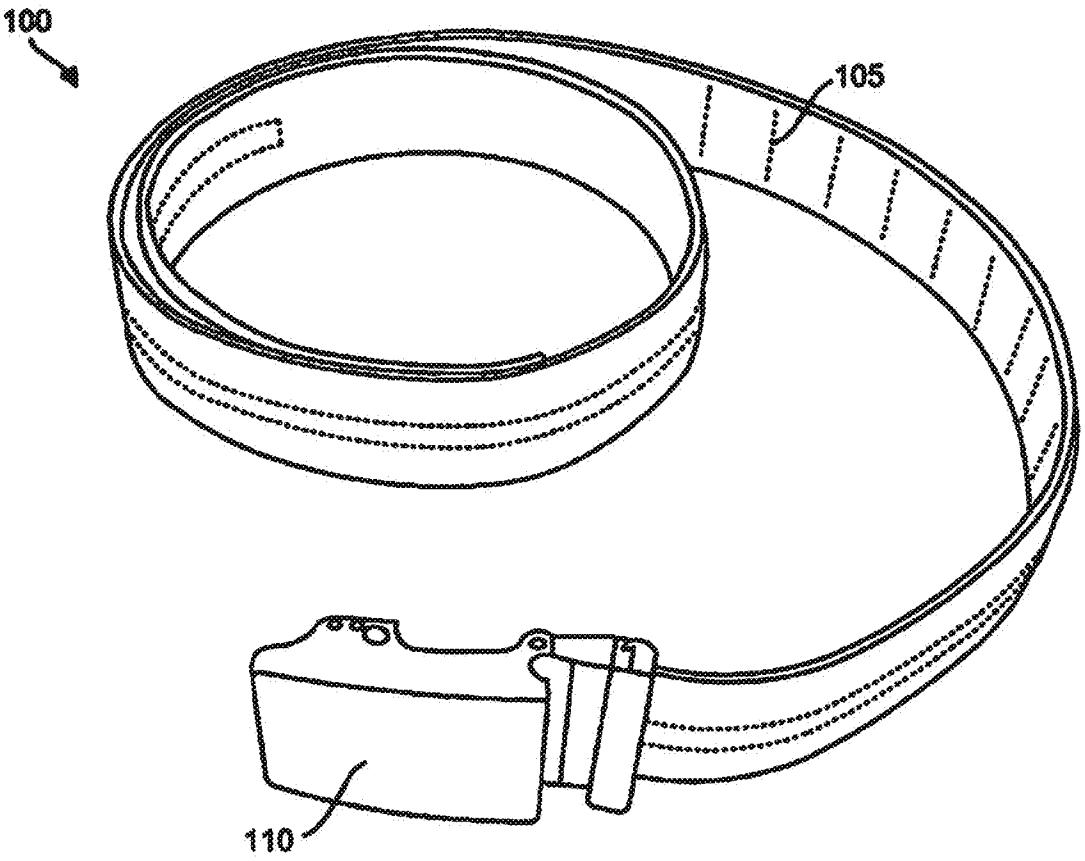
FIG. 1 shows a schematic view of an embodiment of a belt system.

FIG. 1 shows a perspective view of an embodiment of a belt system 100 that may be worn with a pair of pants, shorts, trousers, skirts or other articles of clothing. The system 100 can also be used with other items such as watch straps, purse straps, guitar straps or animal collars or other articles that may include a buckle system that is adjusted for size or where a number of size variations would be desirable. Some figures include exemplary numerical dimensions. It should be appreciated that the dimensions are for example only and are not intended to be limiting. The belt buckle system can be configured with dimensions outside of the ranges and values shown.

The belt system 100 includes an elongated belt 105 and a buckle 110 disposed on a first end of the belt 105. The buckle 110 is removably attached to the belt such as by using a clamp on the buckle 110. The belt buckle 110 is a pinless buckle in that it does not use a pin to secure itself to the belt 105 when the belt is looped around a user's waist. The belt buckle 105 has a front face that faces away from a user or a user's torso when the belt is worn around the user's waist. That is, the belt buckle 105 sits flat against the user's waist or torso such that the buckle will be positioned over the region of the user's pants where a button is typically located on the user's pants. The belt has a first end that attaches to the buckle and a second end that can be looped to also removably engage the buckle. The belt can have a series of teeth or other engagement members that engage a pawl or ratchet mechanism of the buckle.

In an example embodiment, the belt 105 is coupled to a holster that is sized and shaped to hold a firearm, such as a pistol or gun.

Figure 2:
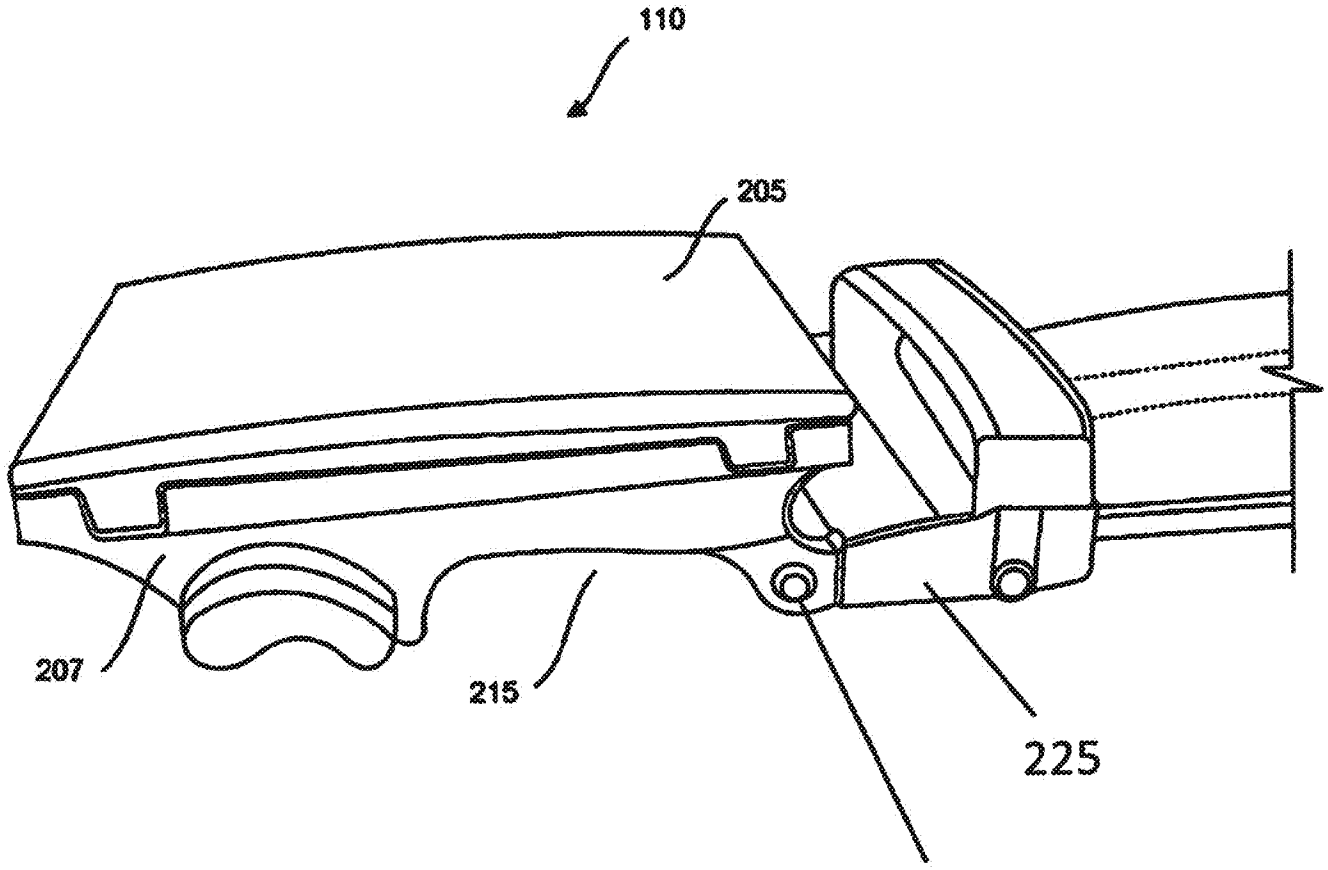
FIG. 2 shows a perspective, side view of a belt buckle of the belt system.
Figure 3:
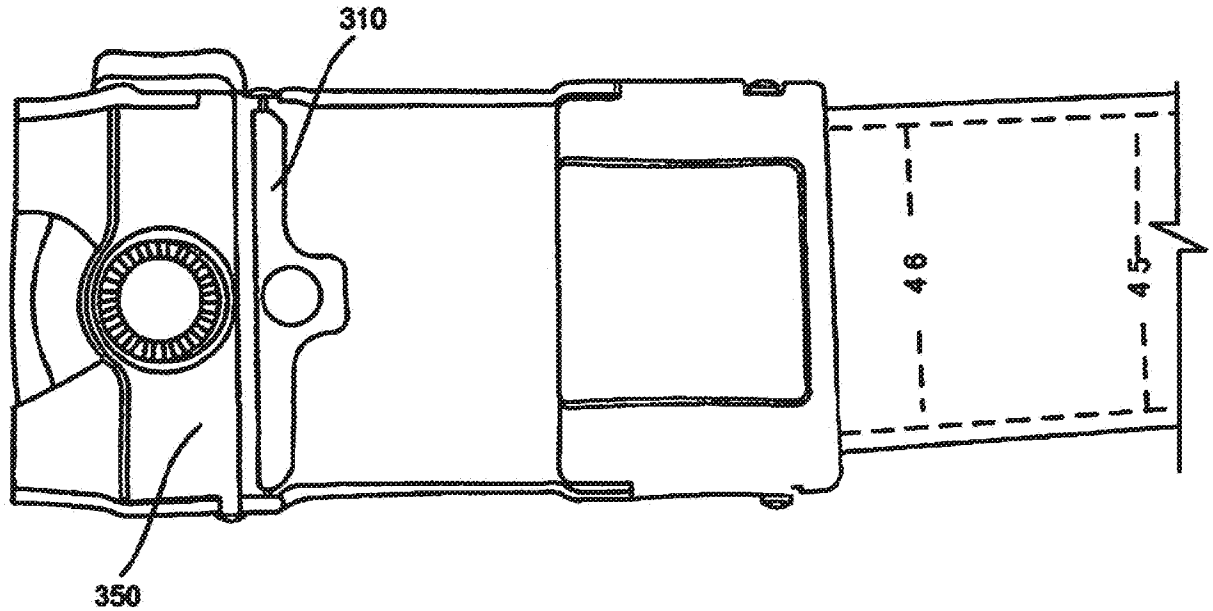
FIG. 3 shows a bottom view of the belt buckle.
Figure 4:
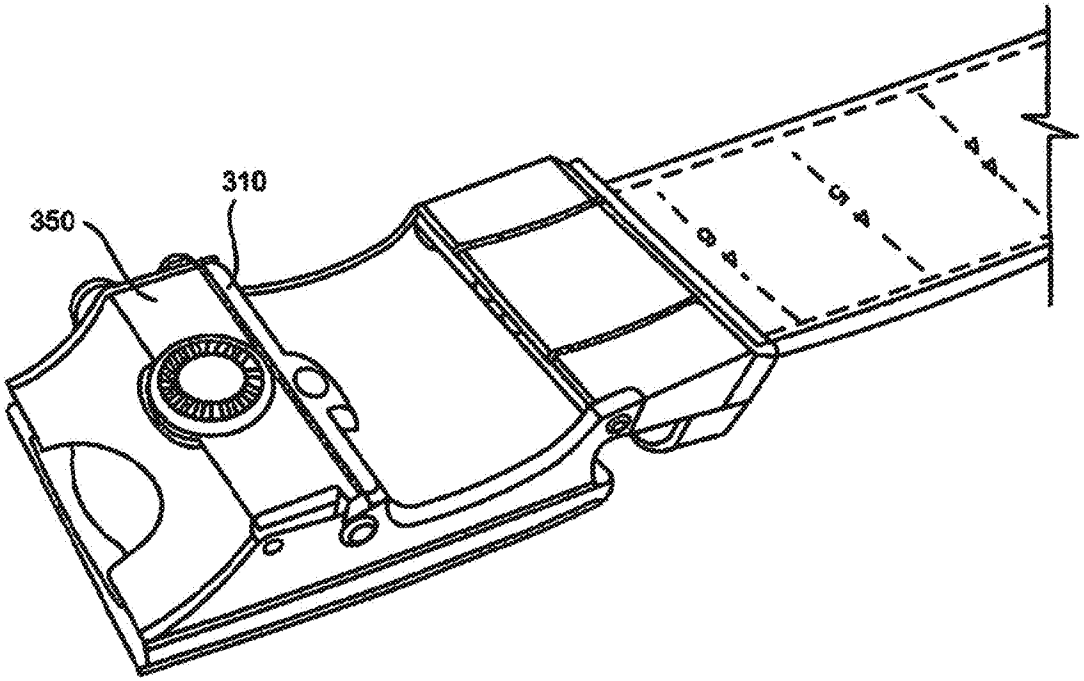
FIG. 4 shows a bottom view of the belt buckle.

FIG. 2 shows a perspective, side view of the belt buckle 110. FIGS. 3 and 4 show bottom views of the belt buckle 110. The belt buckle 110 has a front face that can be formed by a door 205 or other type of movable portion. The door 205 is movable relative to a body 207 of the belt buckle such that the door 205 can be opened (such as in a pivoting manner) relative to the body to expose an internal chamber, as described in more detail below. A belt loop structure 225 is attached to a main body of the buckle 110 such as at one or more attachment locations 230. In an embodiment, the belt loop structure 225 can pivot or rotate about an axis that intersects the attachment location 230. In addition, as described more fully below, at least one threaded member, such as a threaded screw, extends through the belt loop structure 225 and the main body of the buckle 110 to secure the belt loop structure 225 to the main body.

With reference to FIGS. 3 and 4, the buckle 110 has a bridge 350 that forms or at least partially defines an opening through which the opposite end of the belt can be threaded when worn by a user. A movable latch 310 or other pinless member is configures to move towards and engage with a portion of the opposite end region of the belt when the opposite region is positioned through the opening formed by the bridge 350 for securing the belt to the buckle in a desired position. In an embodiment, the latch 310 secures to a tooth, teeth, series of teeth 109 (FIG. 1), or other engagement portion formed within a row of engagement portions on the belt such as located on the second end or end region of the belt that loops into the buckle. The teeth can be located on a side of the belt that faces the movable latch when the belt is looped through the buckle. The latch 310 can be biased toward a latching engagement with the tooth or teeth of the belt such as by using a biasing member, which can be, for example, a magnet, a spring, or other device. In an embodiment described below, the buckle includes two or more biasing members such as both a spring and a magnet system.

As mentioned above with reference to FIG. 2, at least one threaded member, such as a threaded screw, extends through the belt loop structure 225 and the main body of the buckle 110 to secure the belt loop structure 225 to the main body. A threaded member such as a threaded screw can also be used to secure other portions of the buckle 110 to one another. For example, a threaded screw can be used to secure the bridge 350 to the main body of the buckle. This is different and more secure than using a non-threaded pin to secure the buckle portions to one another. A non-threaded pin has a tendency to loosen from the buckle such that the buckle can become unstable or fall apart at some point during use.

Figure 5:
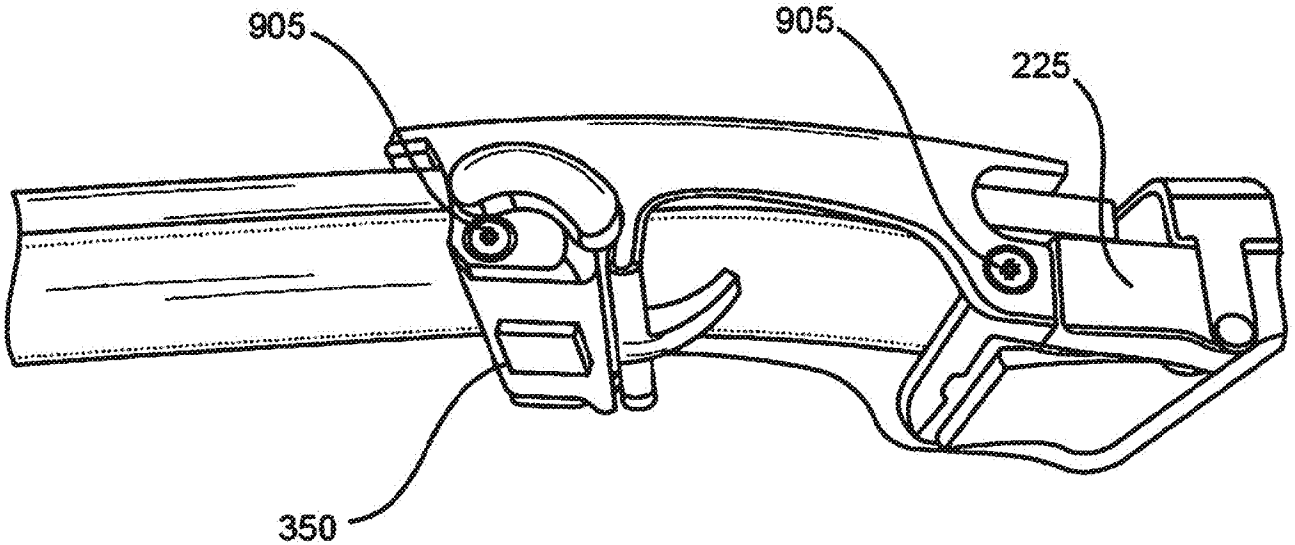
FIG. 5 shows a side view of the buckle with threaded retainer members.

FIG. 5 shows a side view of the belt buckle. One or more threaded members, such as threaded screws 905, secure portions of the belt buckle to one another. For example, threaded screws 905 secure the bridge 350 and/or the belt loop structure 225 to the main body of the belt buckle. In this regard, one or more aligned, threaded openings or passageways can extend through the bridge 350 and the main body. A screw 905 can be threadedly positioned in the aligned passageways to secure the components of the buckle to one another via the screw 905. It should be appreciated that threaded screws can be used to secure other portions of the buckle to one another. In addition, the threaded screw can have various types of heads, such as Allen heads, for attaching to a drive member, such as an Allen wrench.

The threaded screw 905 is an elongated body such a cylindrical body having a head on a proximal end and threads on an external surface of a distal region of the body or over the entire body. The head portion of the screw may be enlarged in diameter relative to a remainder portion of the screw or may have the same diameter as the remainder portion of the screw. The screw 905 is an externally threaded fastener capable of being inserted into holes in any portion of the buckle for securing a first component of the buckle to any other component or components of the buckle. The screw is capable of mating with a preformed internal thread or forming its own thread within the respective hole, and of being tightened or released by torqueing the head. In an example embodiment, the screw has a diameter in the head and/or body portion of 3 mm. In another embodiment, the screw has a diameter of 1-2 mm or 1-3 mm.

It should be appreciated that threaded screws are much more secure than pins or other types of non-threaded structures. The threaded screws can withstand forces that the buckle undergoes during use. The buckle can experience high levels of torque and linear forces, which can cause the buckle to come apart or otherwise malfunction. The threaded screws 905 eliminate or greatly reduce the likelihood that the belt buckle will come apart as a result of such forces.

Figure 6:
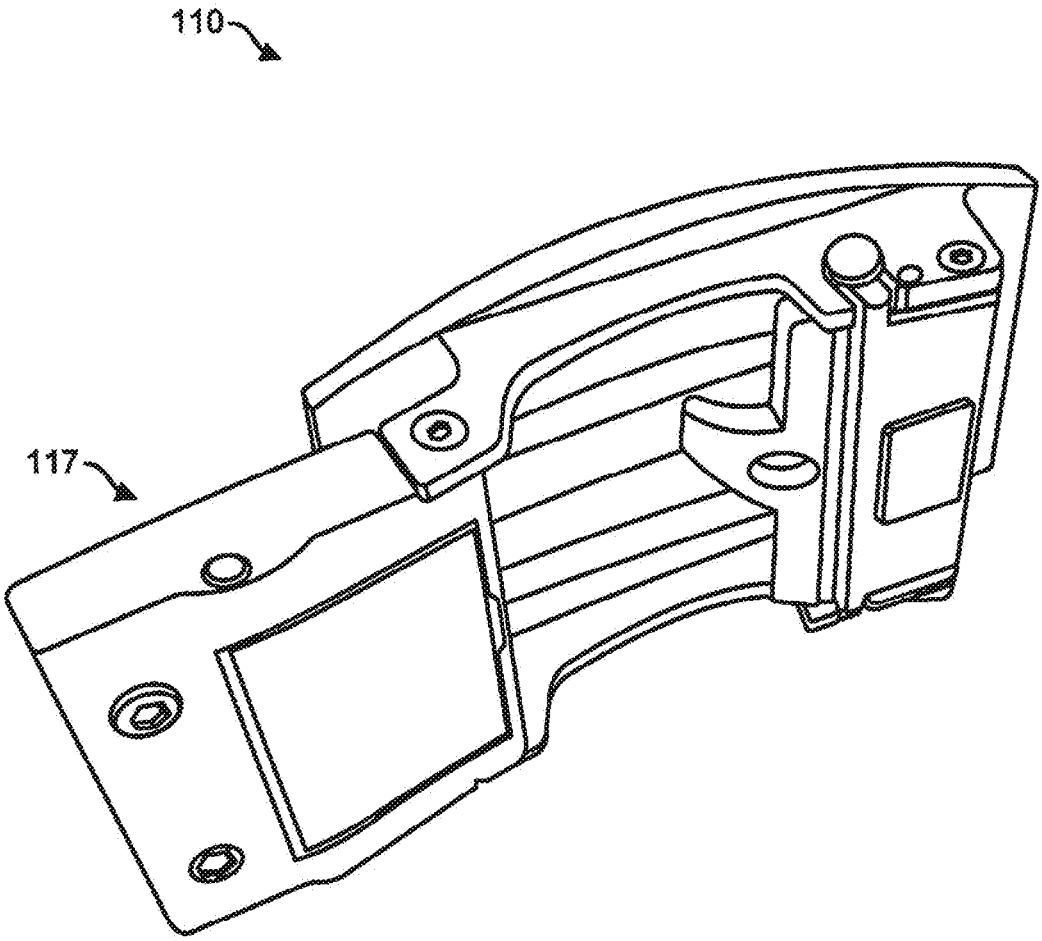
FIG. 6 shows an alternate embodiment of a belt buckle 110.
Figure 7:
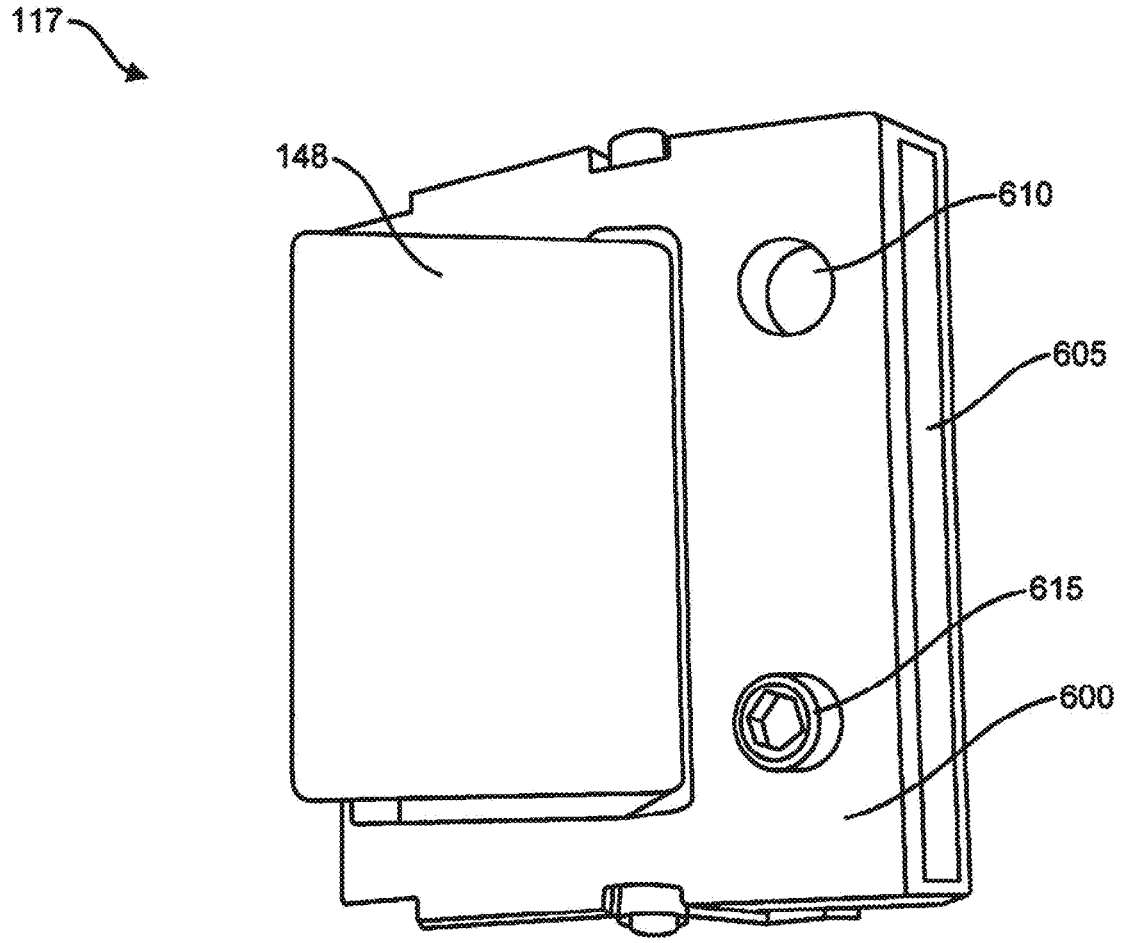
FIGS. 7 through 10 shows a clamp mechanism of the belt buckle of FIG. 6.
Figure 8:
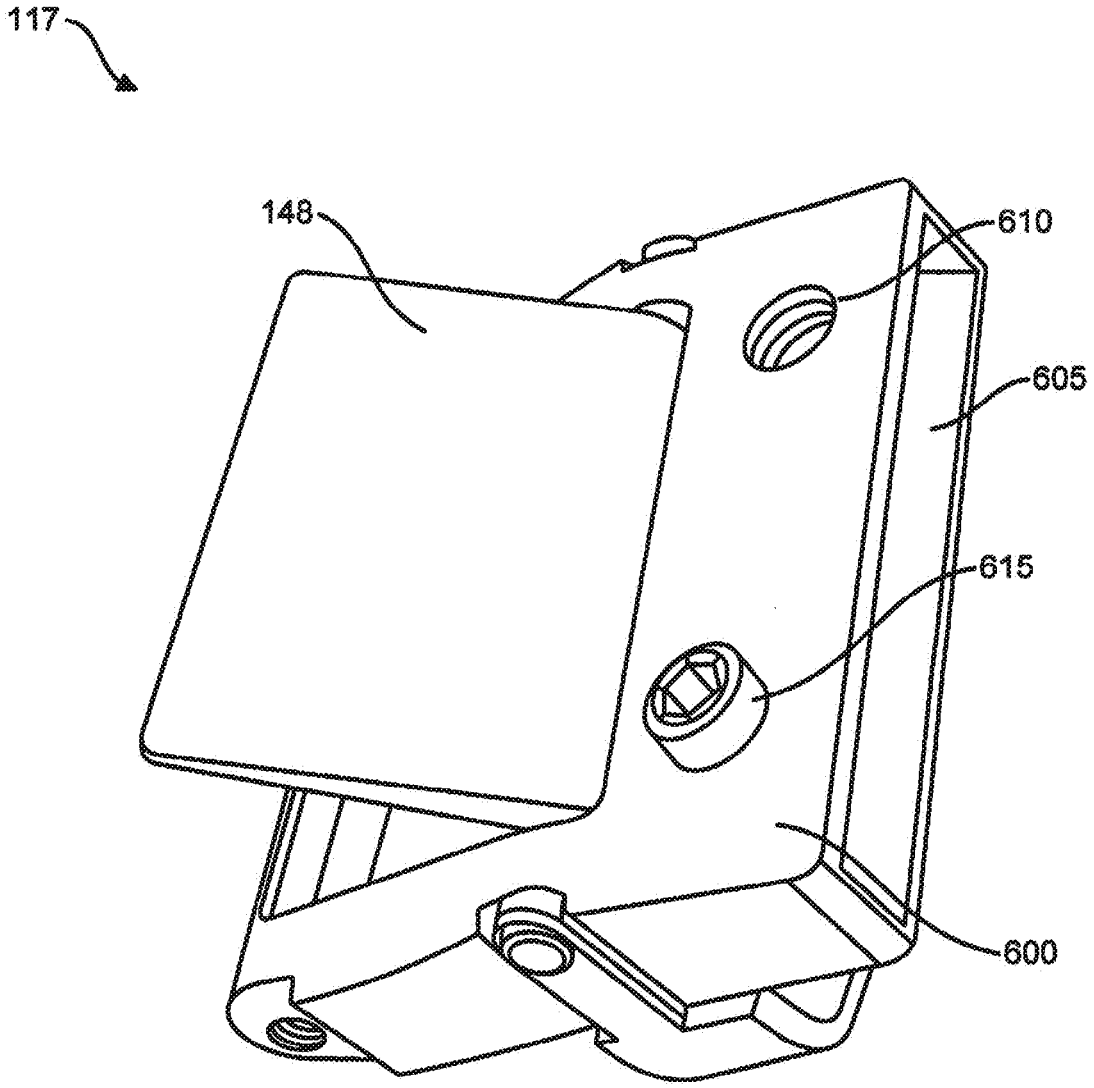

FIG. 6 shows an alternate embodiment of a belt buckle 110. The belt buckle 110 of FIG. 6 has an alternate clamping mechanism 117 that is configured to clamp onto the belt to secure it to the buckle 110. The buckles shown in FIGS. 1 and 6 can have any of the features described with respect to either of the buckles.

FIGS. 7-10 show the clamp mechanism 117 of the buckle of FIG. 6. The clamp mechanism 117 is formed of a main body 600 that defines a slot-shaped mouth or opening 605 that communicates with a belt passageway sized to receive an end or end region of the belt. As mentioned, the clamp mechanism can clamp onto the end of the belt to keep it retained within the buckle. One or more threaded bores 610 are positioned through the body 600 and communicate with the belt passageway of the opening 605. A threaded screw 615 can be threadedly positioned into each bore 610 such that an end of the screw 615 inserts into the belt passageway in a manner that can engage or otherwise contact the belt when the belt is positioned in the passageway. The type of screw can vary. In an embodiment, the screw is an Allen screw with a distal end that is pointed or otherwise shaped to increase the likelihood that the distal end of the screw can insert into or otherwise engage the belt.

Figure 9:
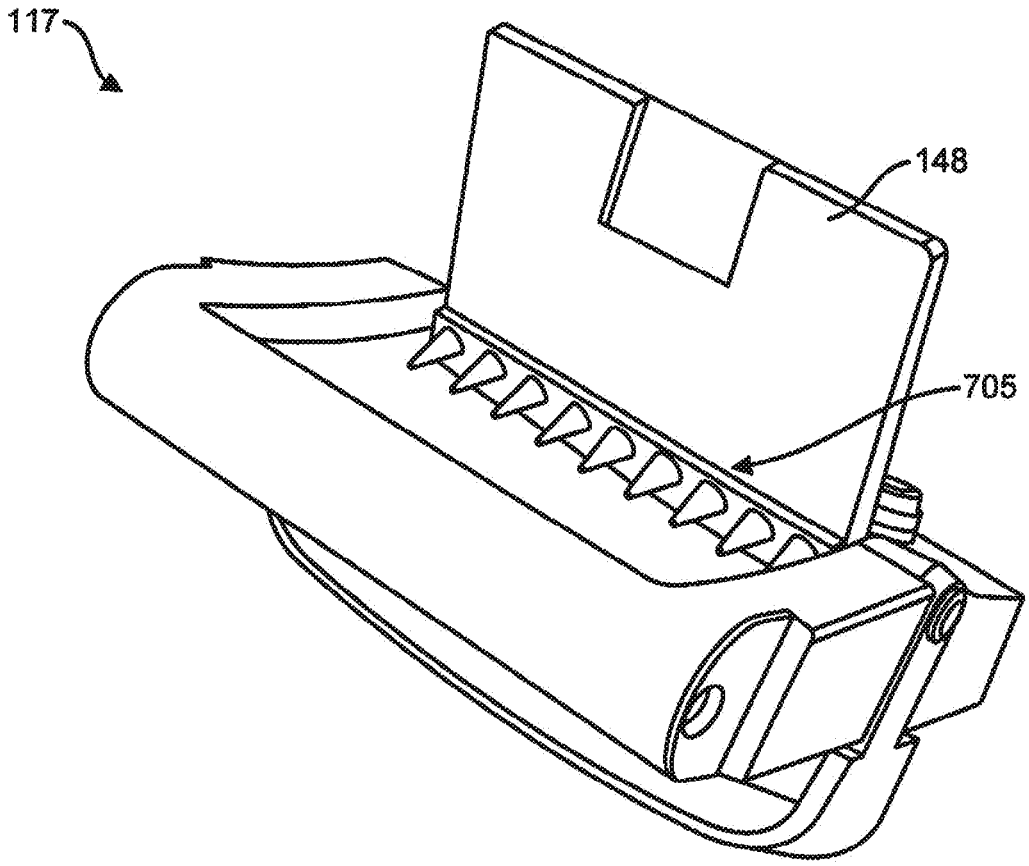
Figure 10:
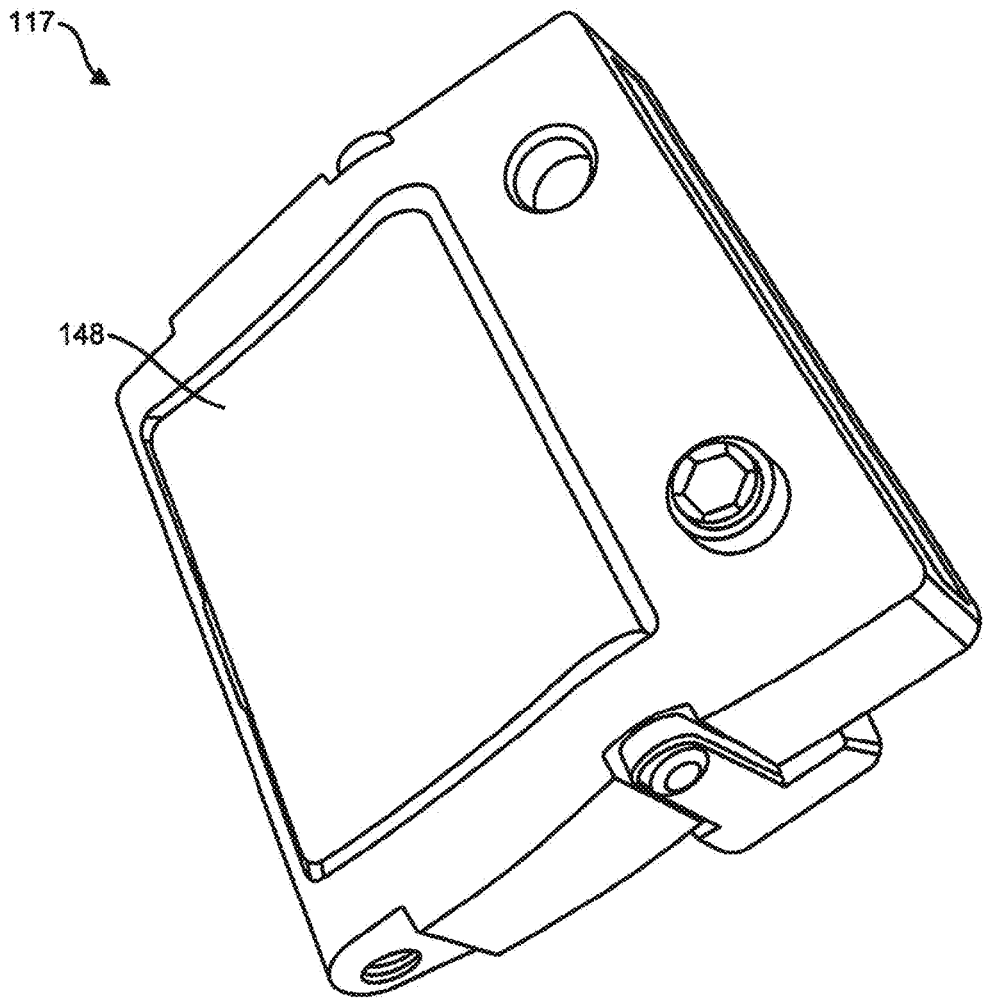

A clamp door 148 is movably attached to the body 600 such that the door 148 can rotate between an open position (as shown in FIGS. 7-10) and a closed position (as shown in FIG. 10). As shown in FIG. 9, a set of retainer members, such as teeth 705 (FIG. 9), are positioned on an inner surface of the door 148 such that the teeth 705 engage a belt when the belt is positioned in the passageway so as to grip against or otherwise retain the belt in position. That is, the teeth press against or partially insert into the belt so as to grip or otherwise retain the belt in position within the clamp mechanism.

The screw(s) 615 can be tightened so that the ends of the screws 615 press against, insert into, or otherwise engage the belt when the belt is positioned in the passageway to retain the belt in position within the clamp mechanism 117. In this manner, the screw(s) 615 act as an additional retaining feature (in addition to the teeth 705) that increases the likelihood that the clamp mechanism will retain the belt within the buckle even when external forces are applied to the belt that might otherwise release the belt from the buckle.

In a method of manufacture, one or more of the components of the buckle are provided. The components are assembled in a manner that forms the shape pf the buckle. One or more of the components can be drilled or tapped with appropriately sized holes, openings, or passageways that are sized and shaped to receive a corresponding screw. One or more of the holes, openings, or passageways can be threaded. An appropriately sized screw can then be inserted into a corresponding opening and threadedly retained in the opening to secure one or more components of the buckle to other components of the buckle. The clamp mechanism is formed and can be attached to the other components to form the buckle.

With reference now to the side view of FIG. 2, the body 207 of the buckle 110 is shaped such that a cavity or cut out 215 is formed on the side of the body 207. The cut out 215 is such that a region of the body 207 is thinner relative to an adjacent region, with the region being thinner along a dimension or direction normal to a wearer's body when the belt is worn around the wearer's waist. That is, the direction is a direction along the line of sight of a person that is facing the wearer and looking toward the front side of the wearer. In this manner, the body of the buckle is so dimensioned so that the wearer's pants button does not contribute to or cause the belt buckle to protrude any further outward from the wearer's pants if the wearer's pants did not have a button in the region of the buckle when the buckle is worn. The cut out is so dimensioned relative to a wearer's pant button so that the pant button fits within the cut out.

The cut out 215 is sized and shaped to form a gap in the body of the buckle in which the wearer's pants button can be positioned when the belt is worn. In this manner, the buckle can be positioned atop the button without the button contributing to the overall size of the buckle or pushing the buckle outward away from the user's body. The button therefore does not interfere with the belt buckle and does not result in the buckle being pushed outward from the user's body when the belt is worn around the waist. FIG. 2 shows one side view of the belt buckle. It should be appreciated that the opposite side view of the belt buckle also has a cutout 215 similar to the cutout 215 shown in FIG. 2. The cut out 215 is located along the length of the belt buckle with the length being the longitudinal direction of the belt member. The cutout 215 extends along only a portion of the entire length of the belt buckle such that the belt buckle has a thickness that is greater where the cavity or cutout 215 is not located relative to whether cavity or cutout 215 is located.

Figure 11:
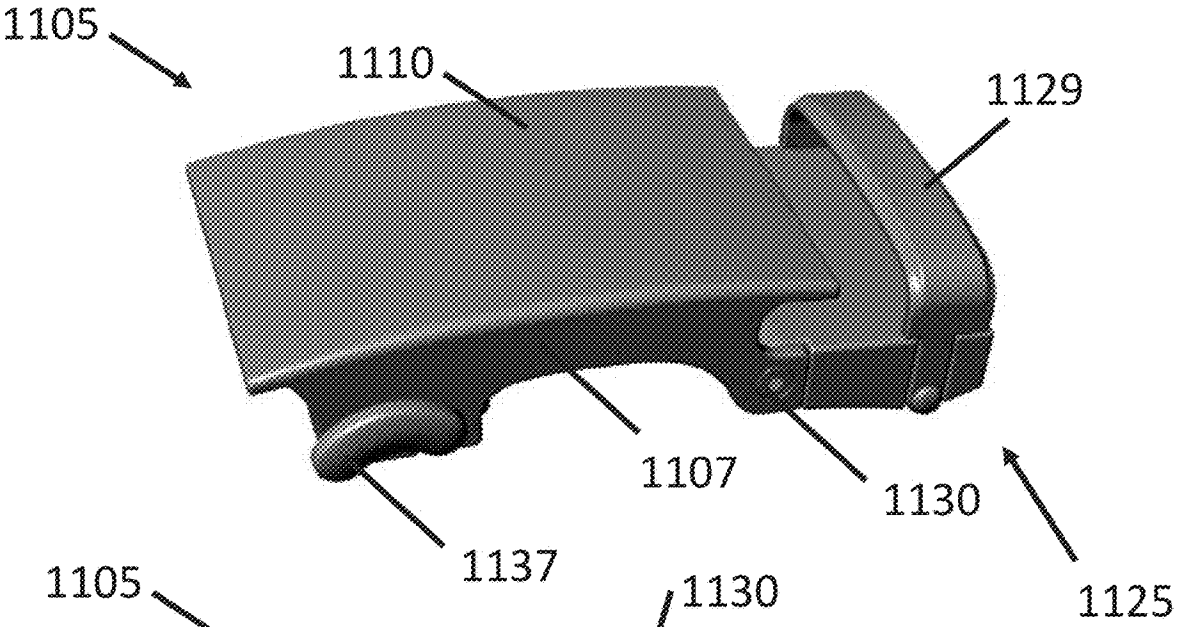
FIGS. 11-14 shows various views of an alternate embodiment of a belt buckle.
Figure 12:
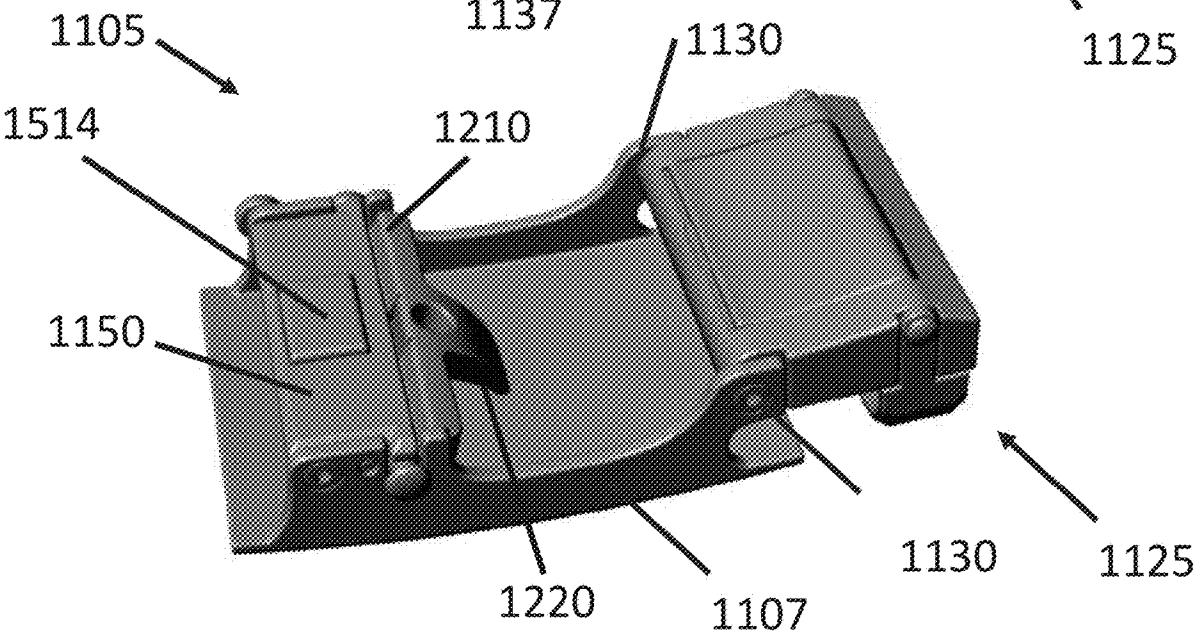
Figure 13:
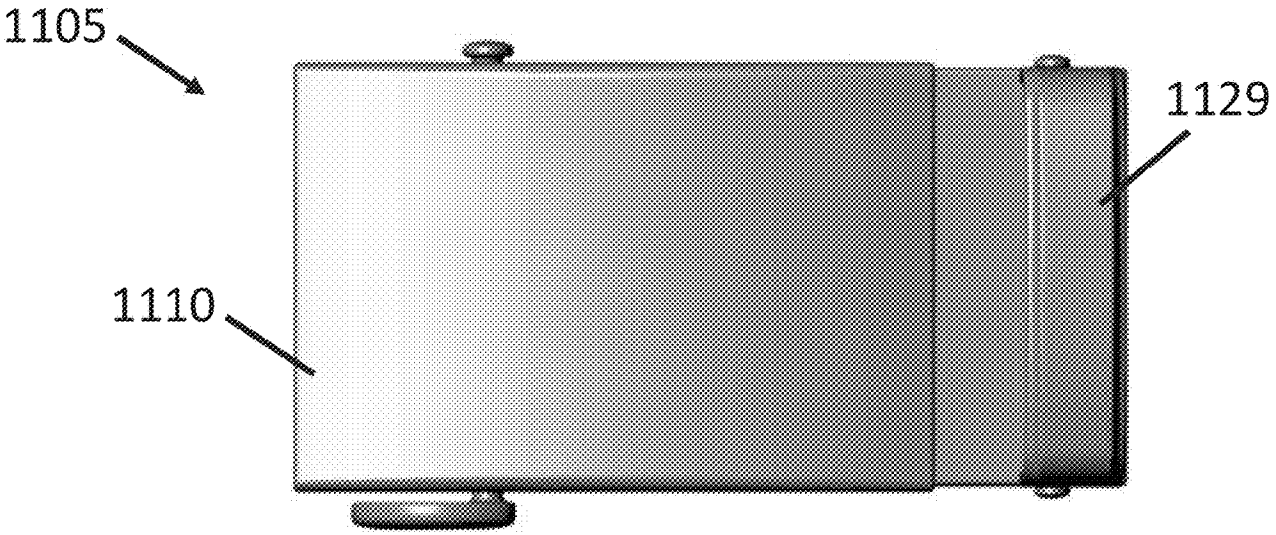
Figure 14:
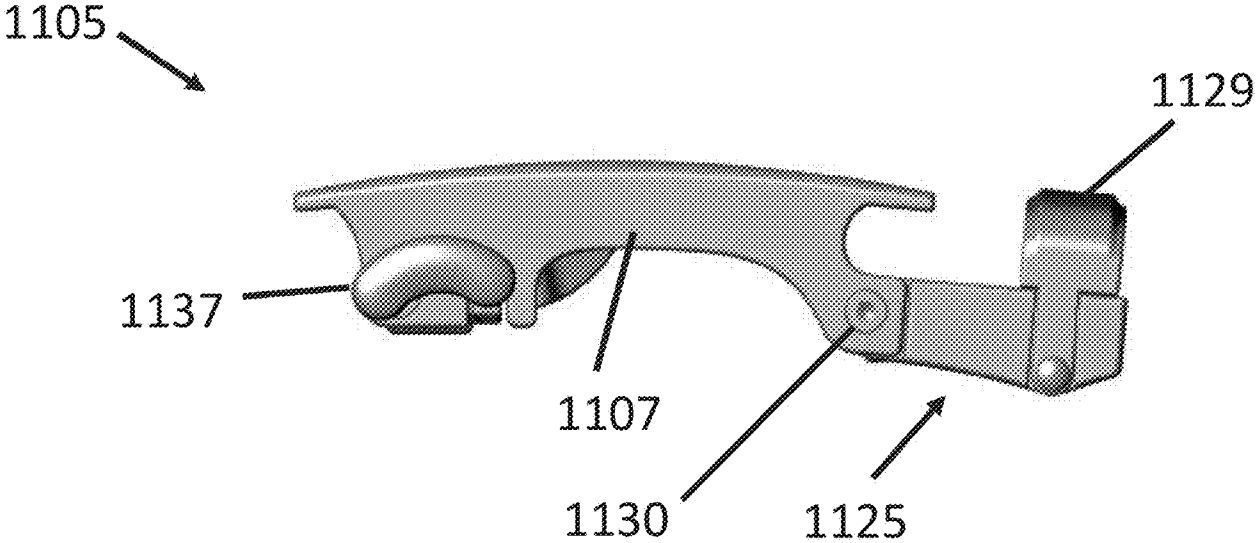
Figure 15:
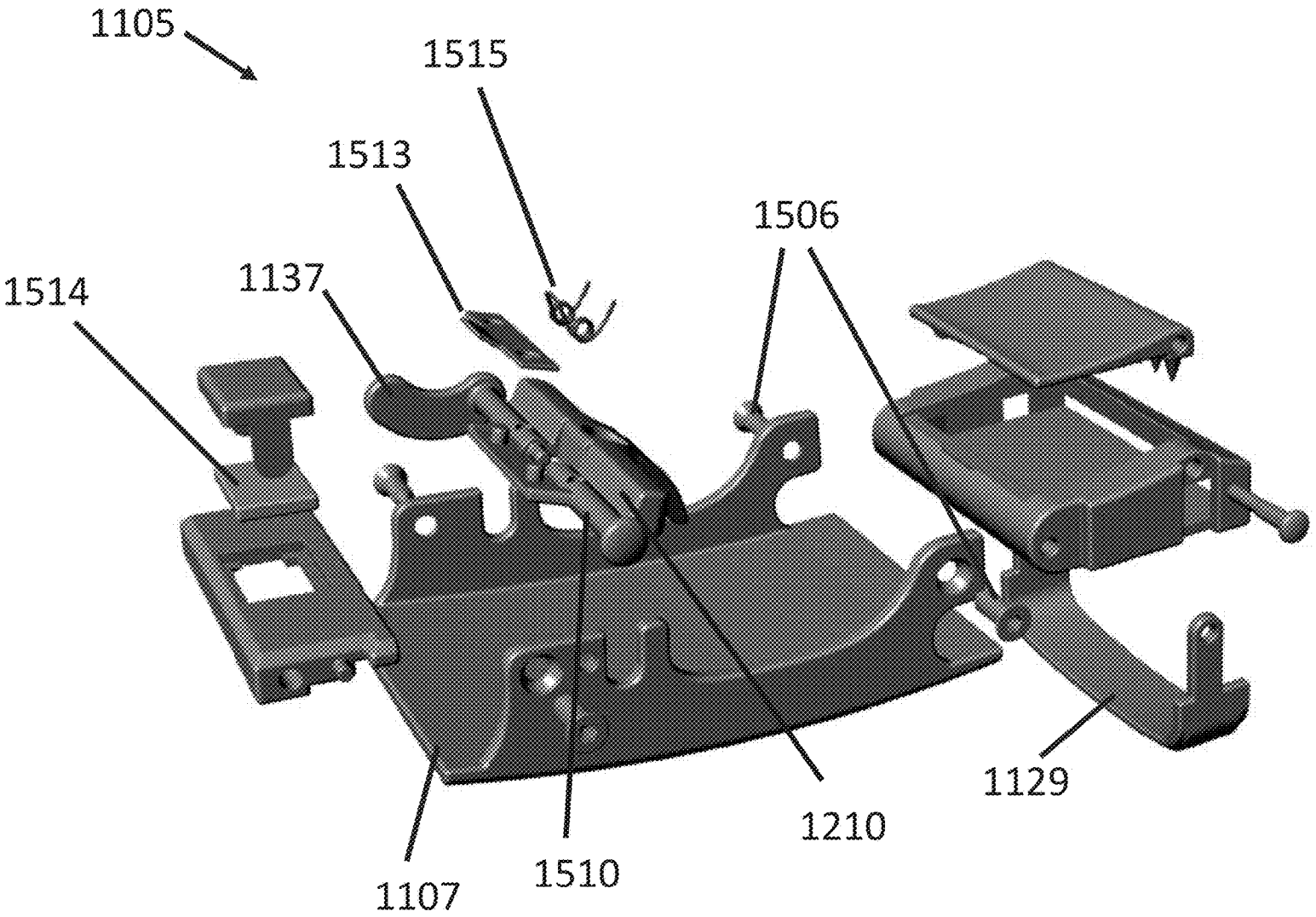
FIG. 15 shows an exploded view of the belt buckle of FIGS. 11-14.

FIGS. 11-14 shows various views of an alternate embodiment of a belt buckle 1105. The buckles shown in FIGS. 1, 6, and 11 can have any of the features described with respect to any of the buckles described herein. FIG. 11 shows a front, perspective view of the buckle 1105 while FIG. 12 shows a rear, perspective view of the buckle 1105. FIG. 13 shows a front view of the buckle 1105 and FIG. 14 shows a side view of the buckle 1105. FIG. 15 shows an exploded view of the belt buckle of FIGS. 11-14.

The belt buckle 1105 has a main body 1107 that defines or otherwise forms a front face 1110 of the belt buckle. A belt loop assembly 1125 is attached to the main body of 1107 the buckle 1105 such as at one or more attachment locations 1130. The belt loop assembly 1125 includes a belt loop 1129 that defines an opening through which an end of the belt can be positioned when in use. In an embodiment, the belt loop assembly 1125 can pivot or rotate about an axis that intersects the attachment location 1130. In addition, as described above with respect to the previous embodiment, at least one threaded member, such as a threaded screw 1506 (FIG. 15), extends through the belt loop assembly 1125 and the main body 1107 of the buckle 1110 to secure the belt loop assembly 1125 to the main body 1107. The belt loop assembly 1125 can also include a clamping mechanism (such as the mechanism described herein) that is configured to clamp onto the belt to secure it to the buckle 1110.

With reference still to FIGS. 11-14, the buckle 1110 has a bridge 1150 that forms or at least partially defines an opening through which an opposite end of the belt can be inserted when worn by a user. A movable latch 1210 (FIGS. 12 and 15) with a pawl or tongue 1220 (FIGS. 12 and 15) or other engagement member is configured to move towards (such as via rotation) and engage with a portion of the opposite end region of the belt when the opposite end region is positioned through the opening formed by the bridge 350 for securing the belt to the buckle in a desired position. In an embodiment, the tongue 1220 of the latch 1210 secures to a tooth, teeth, or series of teeth or other engagement portion formed within a row of engagement portions on the belt, such as in a ratcheting manner. In this regard, the latch 1210 rotates about or with an elongated body 1510 (FIG. 15). The elongated body 1510 defines an axis of rotation about which the latch 1210 rotates relative to the main body 1107. At least a portion of the latch 1210 can include an actuator, such as a tab 1137 by which a user can manually rotate the latch 1210 toward a disengaged state, as described more fully below. The elongated body 1510 can be tubular, cylindrical, pin-like, etc. or can be any portion or combination thereof.

The latch 1210 can be biased toward an engaged state such that the tongue 1220 is in a latching engagement with the belt (such as teeth of the belt). In this regard, the latch can be coupled with one or more biasing members, which can be, for example, a magnet, a spring, or a combination thereof. In an example embodiment, the latch 1210 is coupled to both a spring 1515 (FIG. 15) and a magnet that collectively generate a biasing force that biases and/or secures the latch 1210 toward the engaged state, with the engaged state being a default state. As mentioned, the latch 1210 includes a tab 1137 that can be actuated by a user to rotate the latch 1210 from the engaged state to a disengaged state. In the disengaged state, the tongue 1220 does not engage the belt (or the teeth of the belt) such that the belt can slide freely relative to the belt buckle. When in the engaged state, the tongue engages the belt (or teeth of the belt) so that the belt is locked in position relative to the buckle.

As mentioned, the latch 1210 may include a magnet or magnet assembly. As shown in FIG. 15, the magnet assembly can include a magnetic member 1513 coupled to the latch 1210 and can further include a corresponding element 1514, such as a metal element, coupled to another portion of the buckle (or vice versa) such as to a portion of the bridge 1150. The magnetic member 1513 and the corresponding element 1514 can magnetically attract one another to bias the latch toward the engaged position or engaged state. The latch 1210 is also coupled to a spring 1515 (FIG. 15) that also biases the latch 1210 toward the engaged state. In this manner, the magnet assembly and the spring 1515 collectively bias the latch 1210 toward the engaged state and/or secure the latch in the engaged states. The user can transition the latch 1210 away from the engaged state and toward the unengaged state by rotating the latch 1210 using the tab 1137 in order overcome the biasing forces of the spring and the magnetic assembly.

Duty Belt Embodiment

Figure 16:
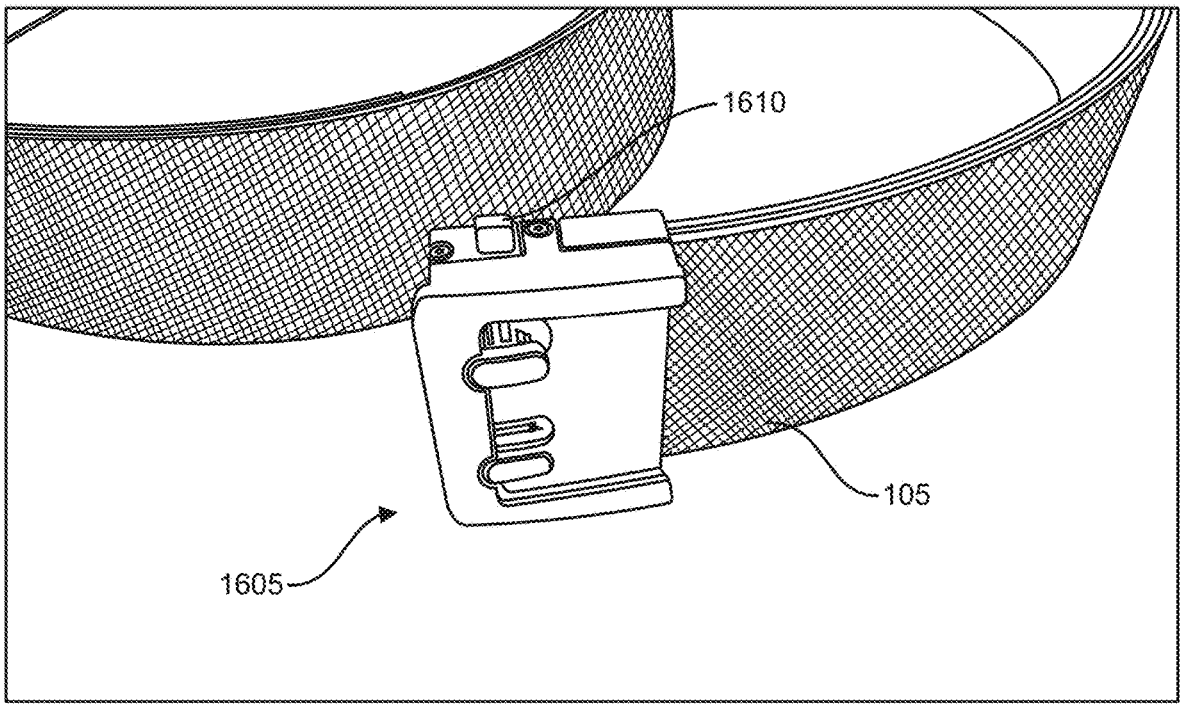
FIGS. 16-28 show other embodiments of a buckle.
Figure 17:
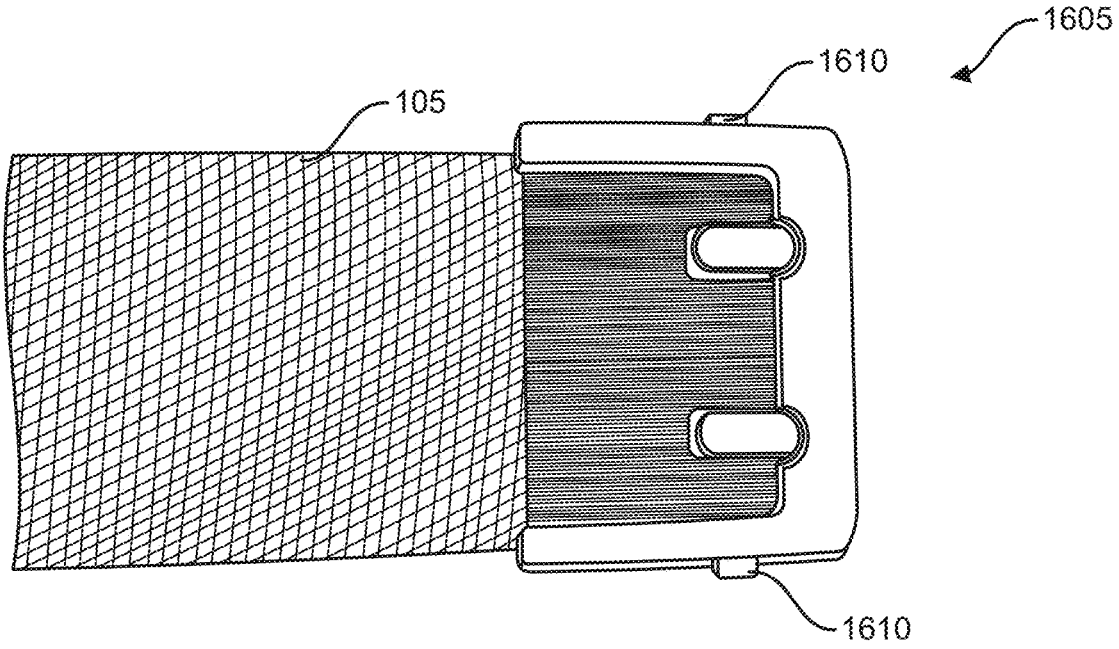
Figure 18:
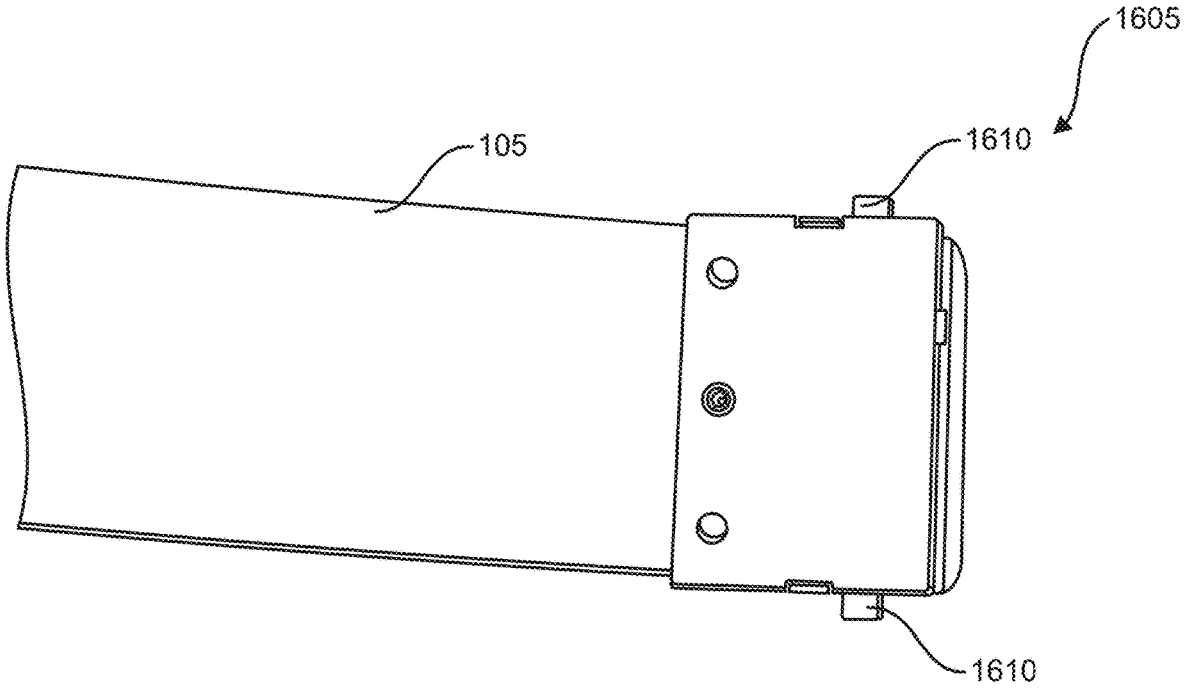

FIG. 16 shows a perspective view of an alternate embodiment of a buckle 1605 attached to a first end of a belt 105. FIG. 17 shows a front view of the buckle 1605. FIG. 18 shows a rear view of the buckle 1605. The buckle 1605 includes a pair of actuators 1610, such as buttons, that can be actuated to cause at least one mechanically coupled engagement member, such as a latch member, to moveably retract relative to the buckle, as described more fully below. In an example embodiment, the buckle 1605 includes two actuators 1610, wherein a single actuator 1610 is each positioned on opposite sides of the buckle 1605. In this manner, a user can actuate the actuators 1610 by placing a thumb and forefinger on opposite sides of the buckle 1605. It should be appreciated that the actuators 1610 can be positioned on various locations of the buckle. In the illustrated embodiment, the actuators 1610 each comprise or otherwise include a button that can be depressed relative to the buckle 1605 for actuation. In an embodiment, the actuators 1610 are elongated pins that are co-axially aligned and positioned within an elongated shaft in the buckle 1605. In another embodiment, the actuators are elongated pins that are parallel and offset from one another so that they are not co-axial.

The buckle 1605 can be attached to the belt 105 in any of a variety of manners. For example, the buckle 1605 can be attached to the belt 105 using screws and/or a clamping member of the type described herein.

Figure 19:
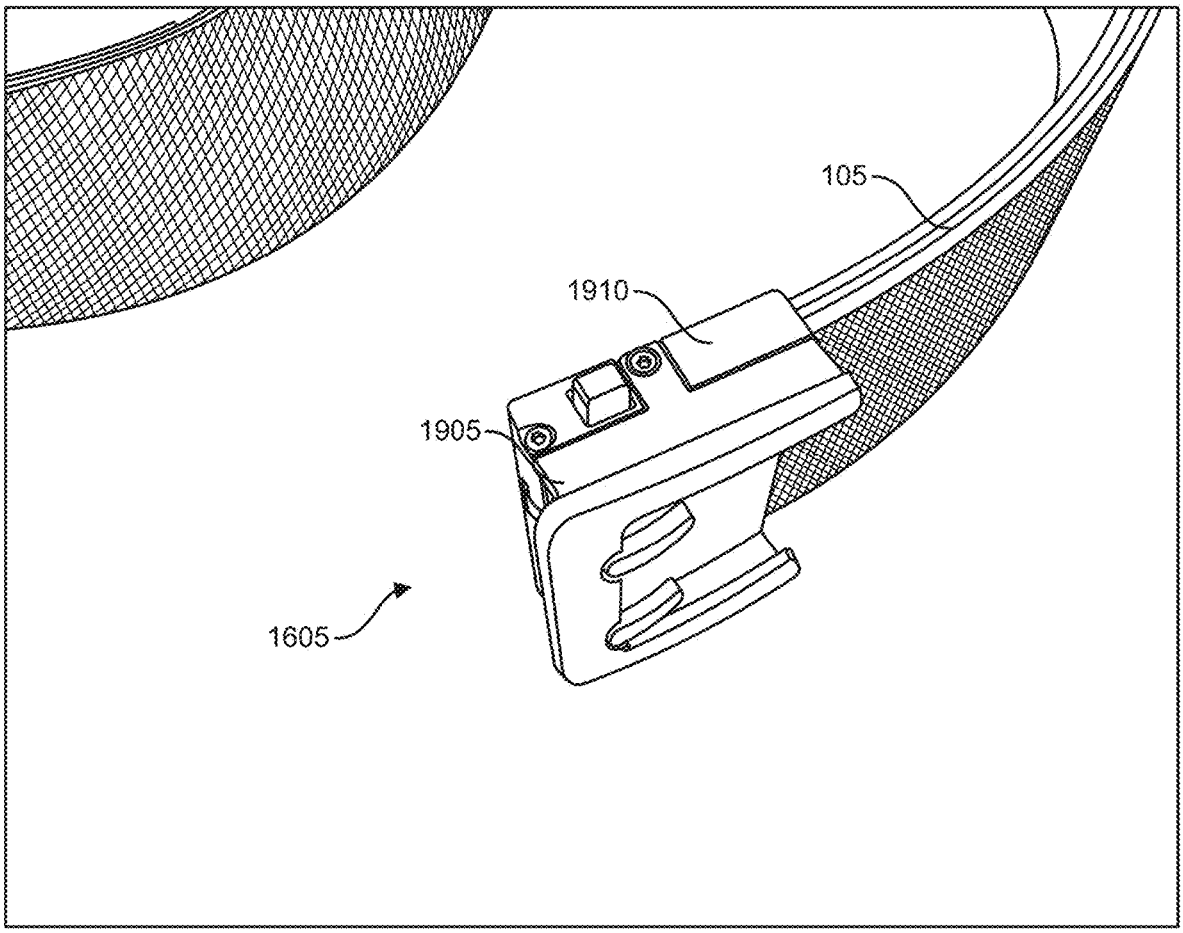

With reference to FIG. 19, the buckle 1605 includes a front member 1905 such as a frame attached to a base member 1910 that forms another frame to collectively form the buckle 1605. The front member 1905 has a portion that is raised relative to the base member 1910 to define a space therebetween that is defined to receive therein a second end of the belt 105. The front member 1905 also defines an opening that is size and shape to receive the second end of the belt 105 there through such that the belt 105 can be positioned between the base member 1910 and the front member 1905, as described more fully below.

Figure 20:
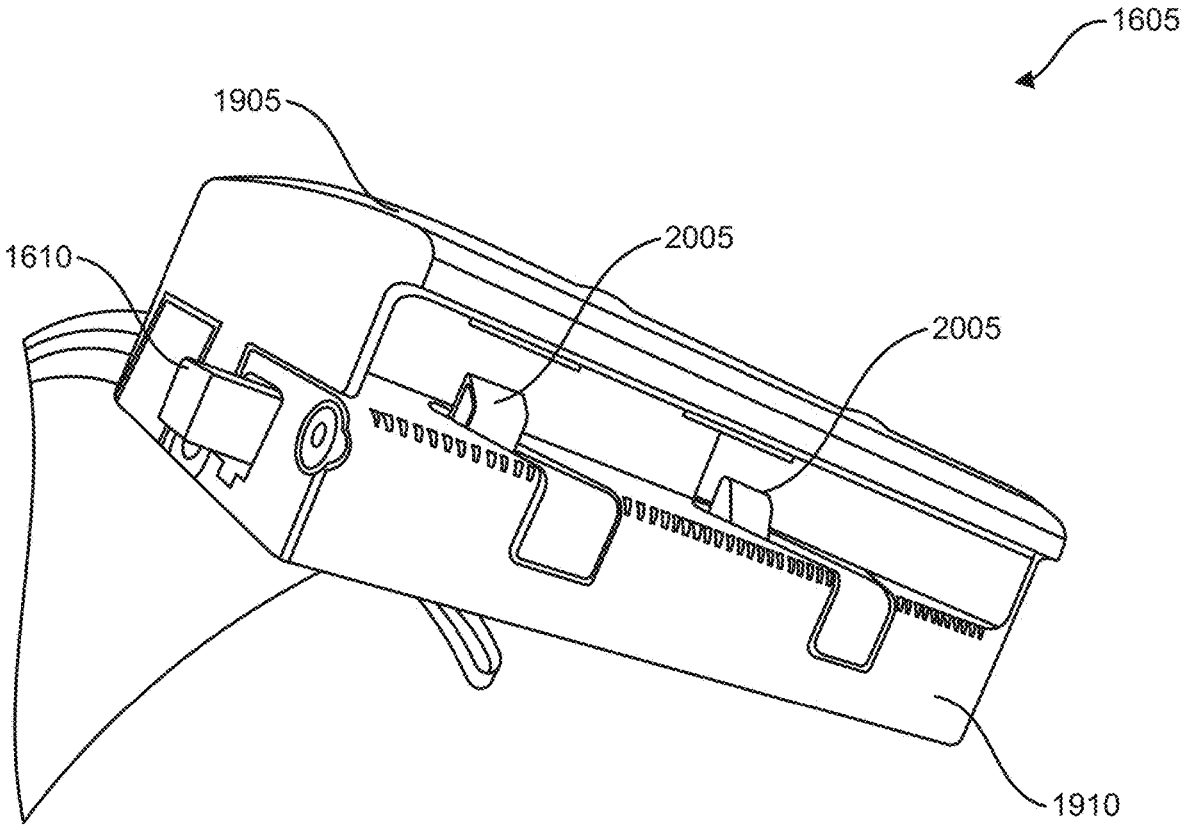
Figure 21:
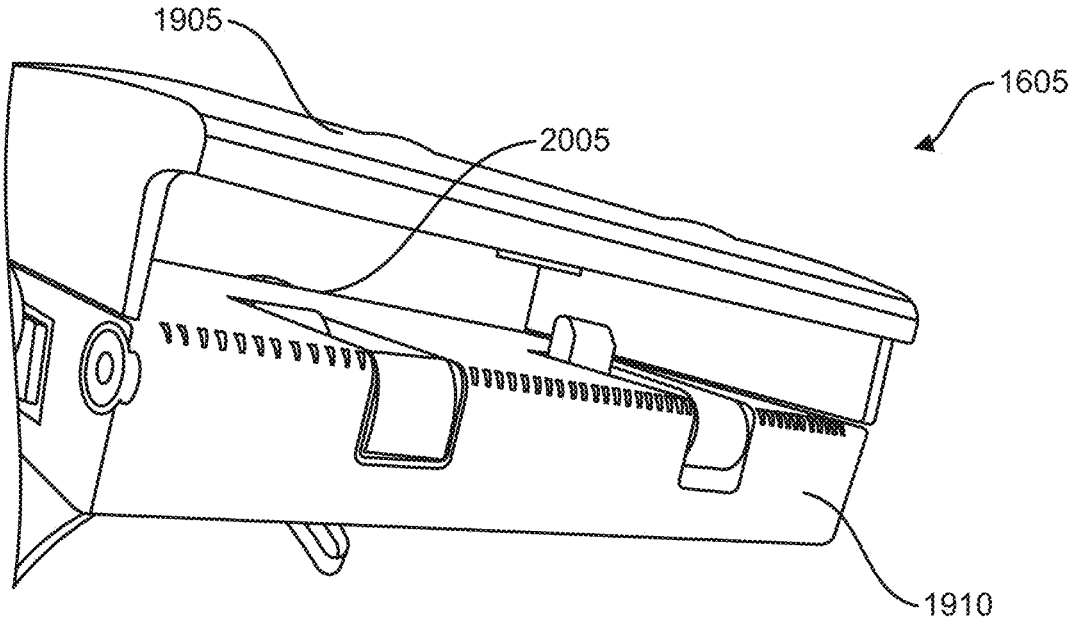

FIG. 20 shows another view of the buckle 1605 and further shows how at least a portion of the front member 1905 is raised relative to the base member 1910. As mentioned, at least one latch member 2005 with a latch portion is positioned to extend upwardly from the base member 1910 into the space between the base member 1910 and the front member 1905. The latch member(s) are positioned in a mechanical relationship within the elongated shaft in which the respective actuators are positioned. The latch member 2005 is biased to be in the extended position shown in FIG. 20. The actuator 1610 can be actuated, such as by pressing and depressing the actuator 1610 to cause the latch member 2005 to at least partially retract into the base member such that it does not engage or otherwise interfere with a belt positioned in the space between the base member 1910 and front member 1905, as shown in FIG. 21. As mentioned, the system can include more than one actuator 1610 with at least one latch member 2005 coupled to each actuator 1610.

Figure 22:
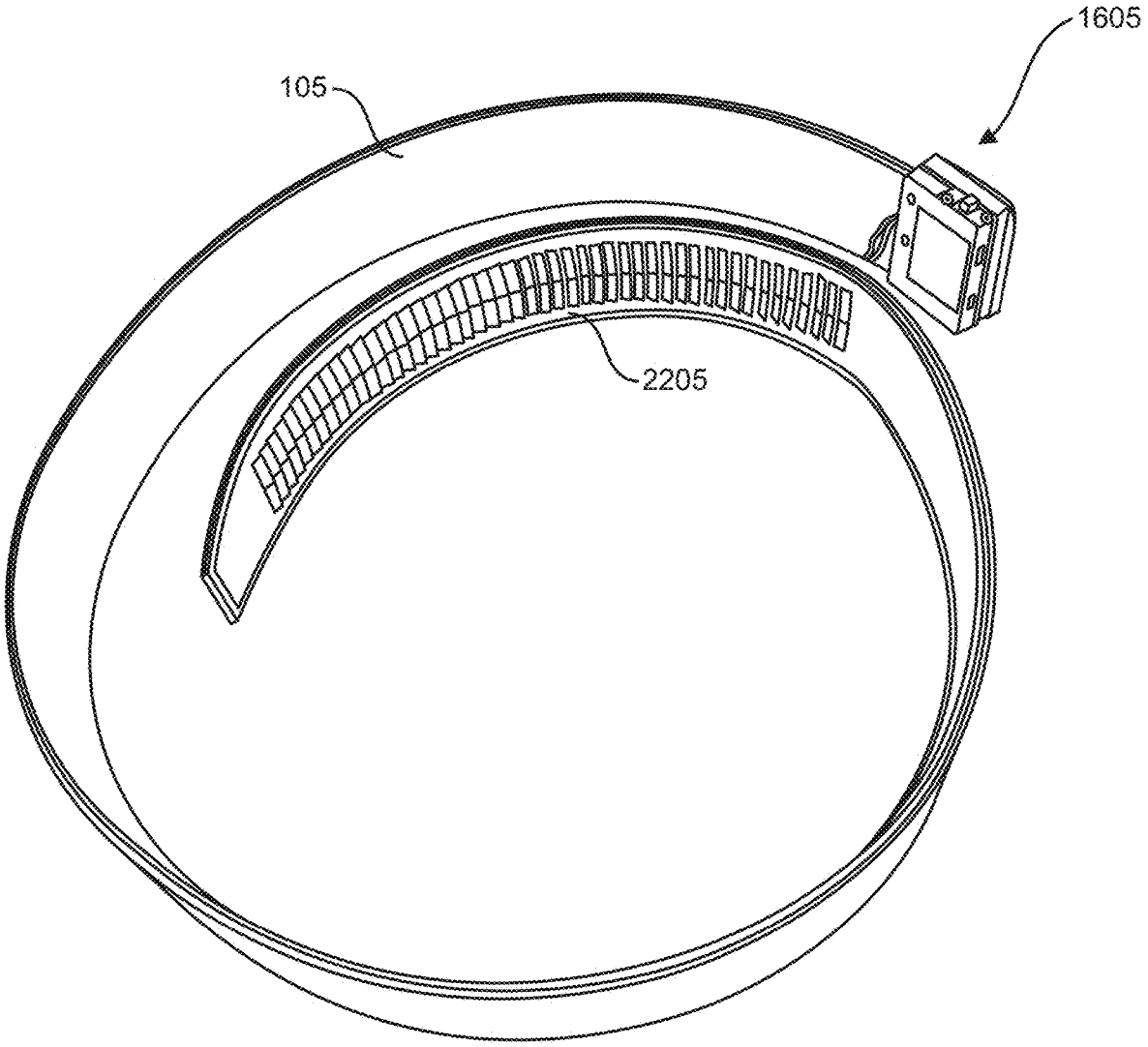

FIG. 22 shows the buckle 1605 and the belt 105. As mentioned, the belt 105 includes a series of teeth or other engagement members 2205 on a second and region of the belt 105. For example, the engagement members 2205 can be a series of inclined teeth into which the latch member(s) 2005 (or pawl) can extend when in the extended position. The engagement members 2205 and the teeth collectively govern motion or restraint of motion between the second end region of the belt and the buckle, such as to lock or unlock the buckle relative to the belt in a desired loop size.

The engagement members 2205 are positioned such that they can engage the latch members 2005 of the buckle 1605 when the belt 105 is looped into the buckle 1605 such as through the opening between the front member 1905 and the base member 1910. In this manner, the latch members 2005 engage with the teeth such as in a ratcheting manner to secure the buckle and the belt member and a desired position. A user can press on or otherwise actuate the actuators to release the latch members 2005 from engagement with the teeth and thereby resize the size of the loop defined by the belt.

Figure 23:
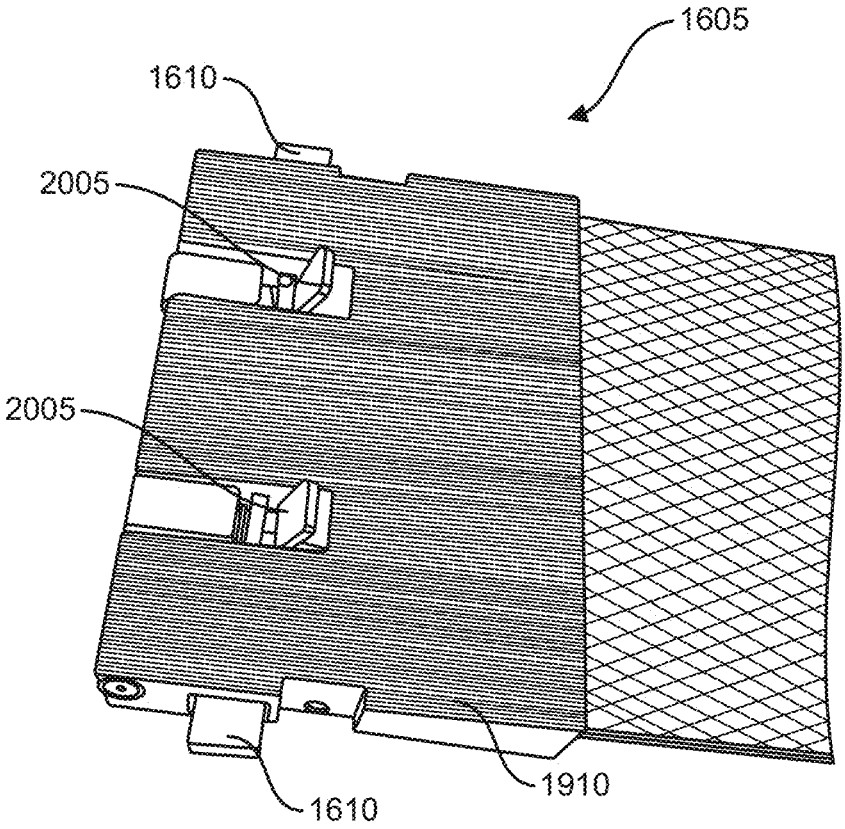

FIG. 23 shows the buckle 1605 with the front member 1905 removed from the base member 1910. The latch members 2005 are visible and in the extended position such that they protrude outwardly from the base member 1910. As mentioned, each of the latch members 2005 is mechanically coupled to at least one actuator 1610. The actuator 1610 can be actuated, such as by pressing on the actuator 1610 to cause the respective latch member 2005 retract from the extended position shown in FIG. 23 to a retracted position wherein the respective latch member 2005 is at least partially retracted into the base member 1910.

The base member 1910 can include an internal mechanism that biases the latch members 2005 into the extended position until the actuators 1610 are actuated (such as by pressing on the actuators relative to the base member) to retract the latch members 2005. In this regard, an internal biasing mechanism, such as spring, can be provided to bias latch members 2005 toward the extended positions.

Figure 24:
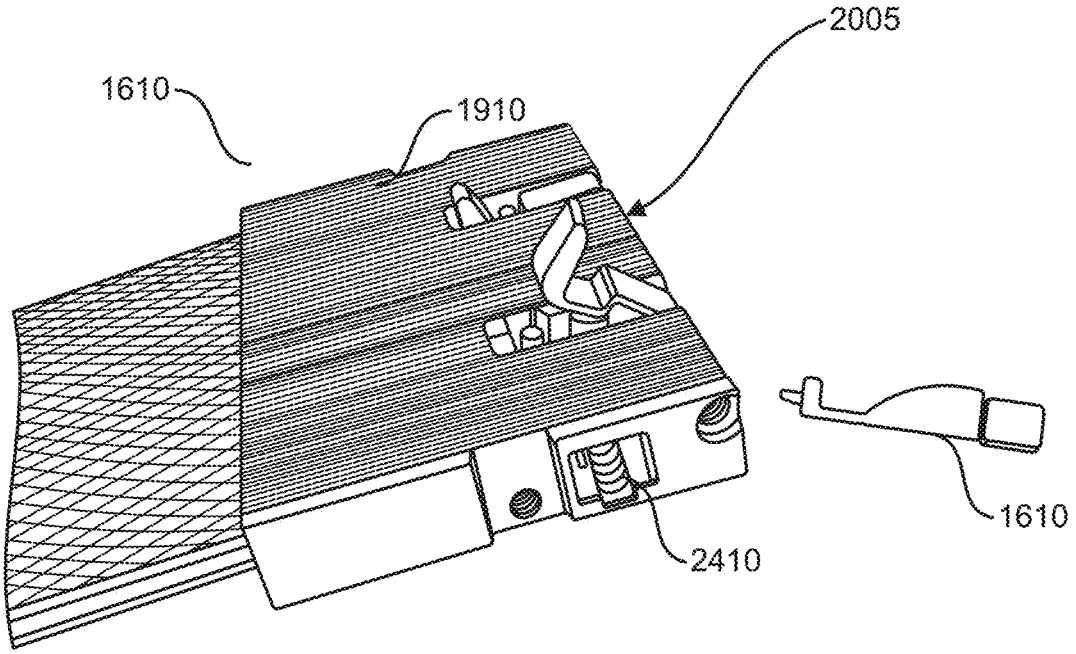
Figure 25:
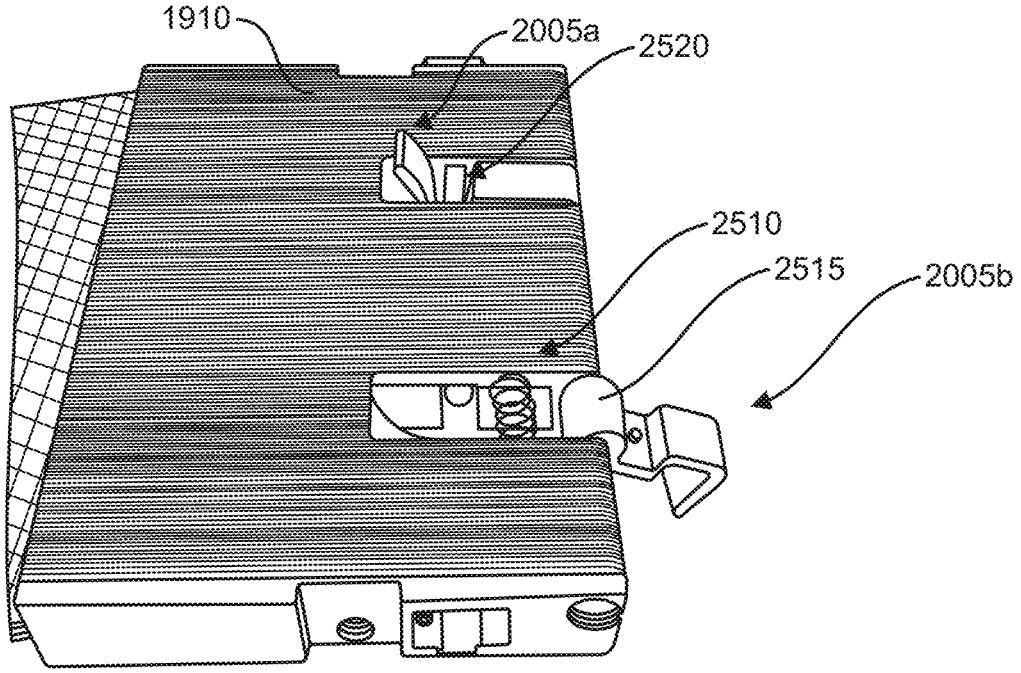

FIG. 24 shows the base member 1910 with the actuator 1610 removed therefrom such that the latch member 2005 is not restrained by the actuator 1610. The actuator 1610 is an elongated member that slidably positions inside an elongated opening or hollow shaft 2410 of the base member 1910. The shaft 2410 intersects with a recession, pocket, or cavity 2415 in the base member 1910 in which latch member 2005 is rotatably positioned. As shown in FIG. 25, a biasing member, such as a spring 2510 is positioned beneath the latch member 2005 to bias the latch member 2005 toward the extended position. The latch member 2005 is configured to rotate relative to the base member 1910 about an axis, pin or shaft (e.g., pin 2720 shown in FIG. 27) positioned inside the base member 1910.

When the actuator 1610 is positioned inside the base member 1910, a portion 2520 of the actuator restrains the latch member 2005 in the extended position and prevents the latch member 2005 from fully rotating to the position of the latch member 2005*b* shown in FIG. 25. Rather, the portion 2520 of the actuator 1610 interferes and restrains with the latch member 2005 to keep it in the position of the latch member 2005*a* shown in FIG. 25.

Figure 26:
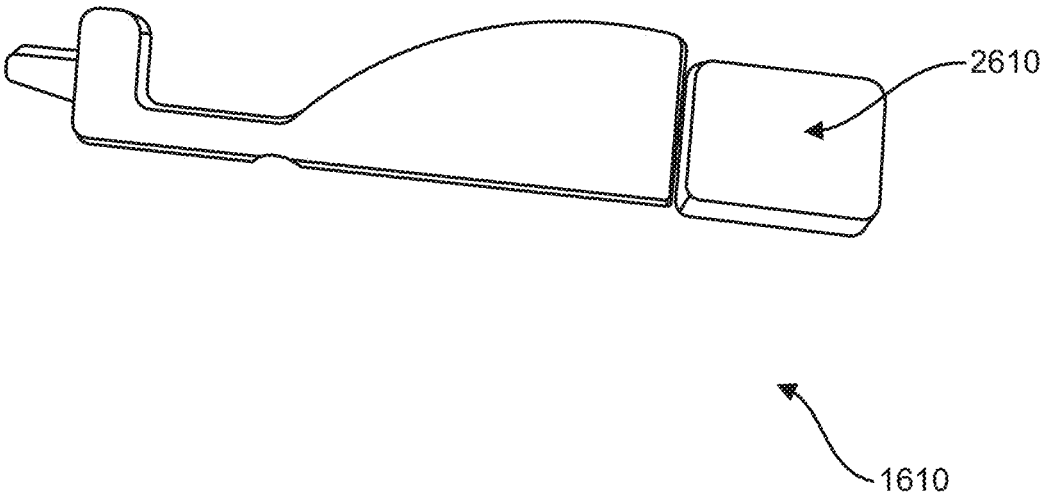

FIG. 26 shows an example embodiment of the actuator 1610 which is in the form of an elongated pin. A button portion 2610 of the actuator is the portion that protrudes out of the base member 1910 in the assembled buckle. A remainder of the actuator 1610 is an elongated body that is slidably positioned inside the shaft 2410 (FIG. 24) of the base member 1910. The actuator 1610 has an inclined (flat or curved) surface (which forms the portion 2520) that slidably engages the latch member 2005 (such as a seat 2515 of the latch member) as the actuator 1610 is pressed into the base member 1910. The inclined surface gradually engages or pushes against the latch member 2005 to overcome the biasing force of the spring 2510 to thereby gradually depress or retract the latch member 2005 into the base member 1910 as the actuator is pressed into the base member 1910. In this manner, depression or pushing of the actuator retracts the latch member into the base member 1910 and disengages the latch member from the ratchet teeth of the belt. This permits the belt to be slidably moved or released from the buckle. A spring or other biasing member can be positioned inside the base member 19102 to bias the button portion 2610 of the actuator outwardly from the base member.

In an alternate embodiment, the buckle includes only a single actuator that is coupled to a single latch member.

Figure 27:
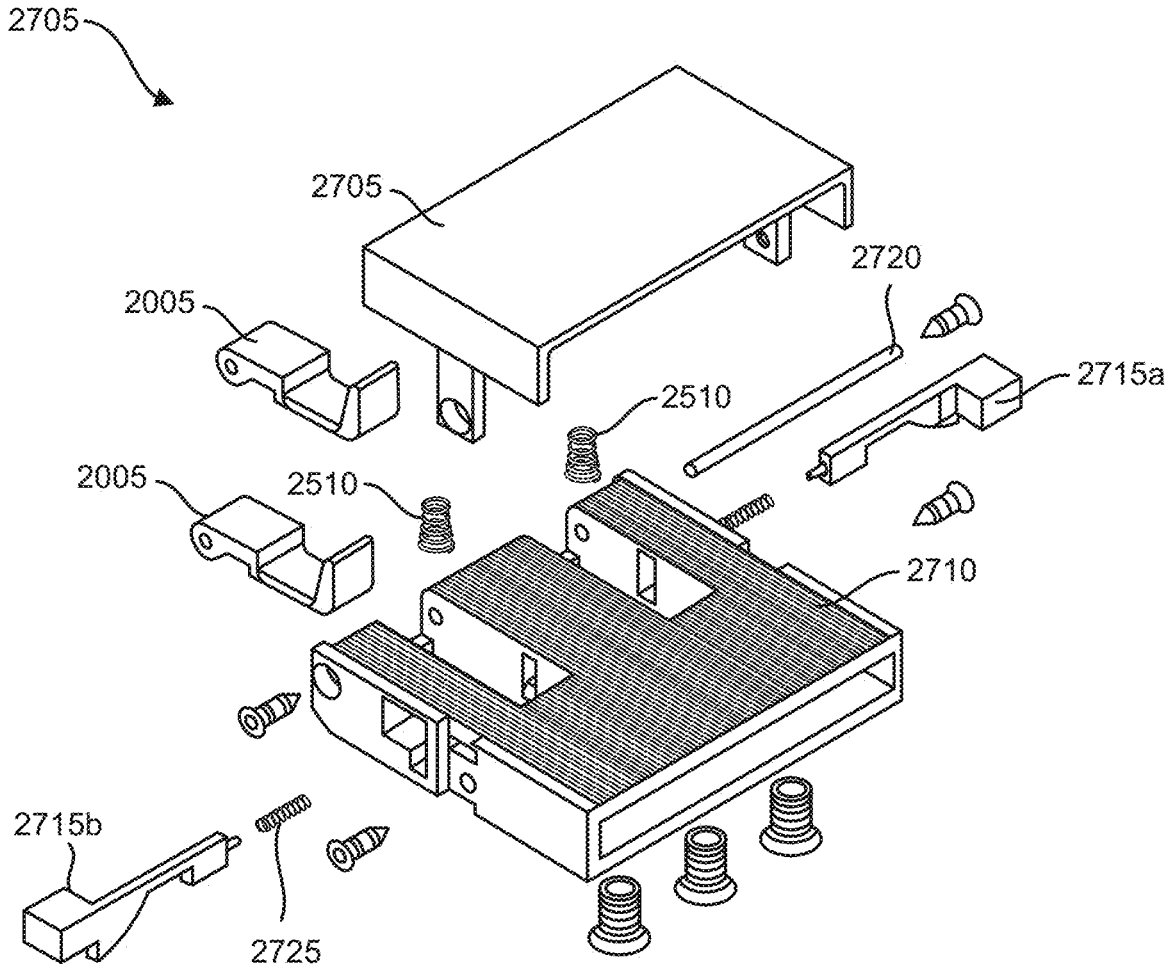
Figure 28:
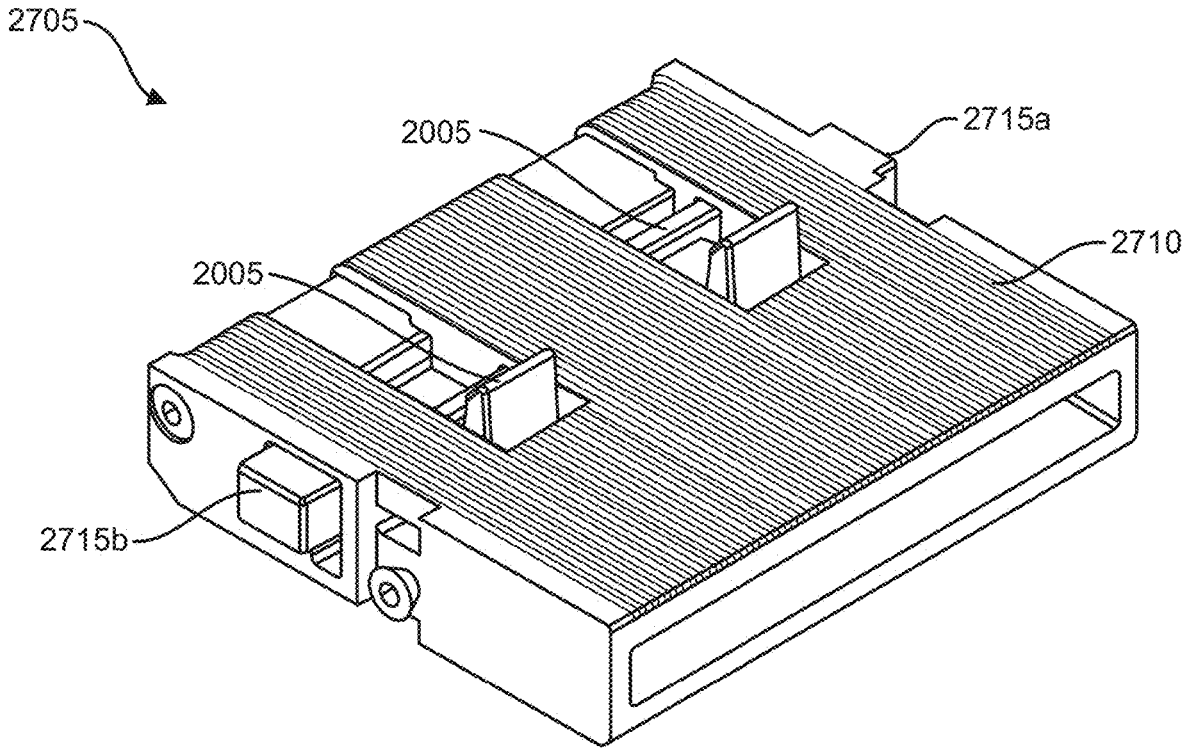

FIGS. 27 and 28 show views of another embodiment of a buckle 2705, which includes a front member 2705 attachable to a base member 2710. FIG. 27 shows an exploded view and FIG. 28 shows a partially assembled view. A pair of elongated actuators 2715*a* and 2715*b* are slidably positioned into respective internal shafts of the base member 2710 in a manner similar to the embodiment of buckle 1605 described above. The actuators 2715 and internal shafts each extend along a respective long axis with the long axis of one actuator 2715 being parallel and offset from one another rather than co-axial. In the prior embodiment of buckle 1605, the actuators 1610 were co-axial when positioned inside the buckle 1605. As discussed in the previous embodiment, each actuator 2715 interacts with a respective latch member 2005. Each latch member 2005 has a latch portion that protrudes or extends outward from the buckle. Each latch member 2005 also includes an attachment portion (which is at an opposite end to the latch portion) such as an opening through which a pin 2720 extends to retain the latch member 2005 within the base member 2710 in a rotatable or pivoting manner such that the latch member 2005 can rotate about the pin 2720. The pin 2720 is positioned inside the assembled buckle and through the opening of the attachment portion of the latch member 2005 so that the latch member

2005 can rotate about the pin 2720. As mentioned in the previous embodiment, the buckle can include a plurality of springs 2510 (for the latch members 2005) and springs 2725 (for the actuators 2715) to bias the latch members 2005 and actuators 2715 in a desired manner. The springs 2510 bias the latch members 2005 toward the extended position while the springs 2725 bias the actuators 2715 with the pin portions extending outward of the buckle. The user can then push the actuators inwardly toward the buckle such that the inclined surfaces of the actuators mechanically engage and push the latch members toward the retracted position. In this regard, the inclined surfaces gradually push against the latch members to gradually retract the latch members by overcoming the spring force of the springs 2510. Thus, the latch members gradually retracts as the actuators are pushed into the buckle. The buckle can also include a plurality of screws or other retaining members to secure the buckle in an assembled state.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results. Only a few examples and implementations are disclosed. Variations, modifications and enhancements to the described examples and implementations and other implementations may be made based on what is disclosed.

Although embodiments of various methods and devices are described herein in detail with reference to certain versions, it should be appreciated that other versions, embodiments, methods of use, and combinations thereof are also possible. Therefore, the spirit and scope of the appended claims should not be limited to the description of the embodiments contained herein.

The invention claimed is:

1. A belt buckle system, comprising:

a belt buckle frame member having at least one elongated internal shaft that extends along a first long axis;

a first elongated actuator member slidingly positioned within the internal shaft, the first elongated actuator member is positioned along a second long axis that is co-axial with the first long axis of the internal shaft, and wherein the first elongated actuator member has an inclined surface;

a first latch member rotatably positioned within the buckle frame between an extended position, wherein a latch portion of the first latch member extends at least partially outward from the belt buckle frame, and a retracted position, wherein the latch portion is at least partially retracted within the frame; and wherein in response to actuation of the first elongated actuator, the inclined surface of the first elongated actuator slidingly engages the first latch member to position the latch portion between the extended position and the retracted position.

2. The belt buckle system of claim 1, further comprising a second elongated actuator and a second latch member.

3. The belt buckle system of claim 2, wherein the second elongated actuator is co-axial with the first elongated actuator.

4. The belt buckle system of claim 1, wherein the first latch member is biased toward the extended position.

5. The belt buckle system of claim 1, further comprising a belt attached to the belt buckle frame.

6. The belt buckle system of claim 5, wherein the belt includes a series of teeth that engage the first latch member in a ratchet relationship when the first latch member is in the extended position.

7. The belt buckle system of claim 1, wherein the belt buckle frame is formed of a base member and front member.

8. The belt buckle system of claim 1, wherein the inclined surface of the first elongated actuator is curved.

9. The belt buckle system of claim 1, wherein the inclined surface of the first elongated actuator is flat.

10. The belt buckle system of claim 1, wherein the first elongated actuator member has a button portion that protrudes out of the belt buckle frame member and wherein the first elongated actuator has a second portion slidably positioned inside the internal shaft.

11. The belt buckle system of claim 1, wherein the first elongated actuator member is an elongated pin.

12. The belt buckle system of claim 2, wherein the second elongated actuator extends along a third long axis that is parallel to and offset from the second long axis.

13. A belt system comprising:

a belt having a plurality of ratchet teeth;

a belt buckle secured to an end of the belt, the belt buckle including:

a belt buckle frame member having at least one elongated internal shaft;

a latch member disposed within the buckle frame and rotatable between an extended position, wherein a latch portion of the first latch member is biased by a biasing mechanism to position the latch portion outward from the belt buckle frame to engage the ratchet teeth, and a retracted position, wherein the latch portion is at least partially retracted within the frame to disengage from the ratchet teeth;

an actuator member slidingly positioned within the internal shaft, the actuator member having an inclined surface configured such that in response to actuation of the actuator member, the inclined surface of the first elongated actuator slidingly engages the first latch member to compress the biasing mechanism and position the latch portion from the extended position.

14. The belt system of claim 13, further comprising a second actuator member and a second latch member.

15. The belt system of claim 14, wherein the second actuator member is co-axial with the actuator member.

16. The belt system of claim 13, wherein the inclined portion is curved.

* * * * *